US005626182A

United States Patent [19]

Bortoloni

[11] Patent Number: 5,626,182

[45] Date of Patent: May 6, 1997

[54] DIE FOR CASTING VEHICLE WHEEL RIMS WITH TUBULAR SPOKES AND OBTAINED WHEEL RIM

[76] Inventor: Andrea Bortoloni, 191 via Noventana, Noventa Padovana, Italy, 35027

[21] Appl. No.: 528,417

[22] Filed: Sep. 14, 1995

[30] Foreign Application Priority Data

| | | | |
|---|---|---|---|
| Feb. 15, 1995 | [IT] | Italy | PD95A0039 |
| Mar. 8, 1995 | [IT] | Italy | PD95A0053 |
| Mar. 20, 1995 | [IT] | Italy | PD95A0059 |

[51] Int. Cl.[6] ..... B22C 9/28

[52] U.S. Cl. ..... 164/340; 164/342; 249/56

[58] Field of Search ..... 164/340, 342, 164/343; 249/56

[56] References Cited

U.S. PATENT DOCUMENTS

| | | | |
|---|---|---|---|
| 1,510,231 | 9/1924 | Keller et al. | 164/340 X |
| 1,561,983 | 11/1925 | Keller et al. | 249/56 |
| 4,492,264 | 1/1985 | Gaddi | 164/342 X |
| 5,311,918 | 5/1994 | Scott | 164/342 X |
| 5,427,171 | 6/1995 | Prieto | 164/342 X |

FOREIGN PATENT DOCUMENTS

| | | | |
|---|---|---|---|
| 2-235549 | 9/1990 | Japan | 164/340 |
| 900959 | 1/1982 | U.S.S.R. | 164/340 |

*Primary Examiner*—J. Reed Batten, Jr.

*Attorney, Agent, or Firm*—Dowell & Dowell

[57] ABSTRACT

The die includes fixed or movable protuberances associated with die parts corresponding to the rim circumference. In the rim thus obtained the inner part of the spokes is hollow and communicates with the rim channel inside the tire but the hollow is spaced from the wheel hub.

3 Claims, 2 Drawing Sheets

DIE FOR CASTING VEHICLE WHEEL RIMS WITH TUBULAR SPOKES AND OBTAINED WHEEL RIM

BACKGROUND OF THE INVENTION

1. Field of the Invention

The present invention concerns the production of rims with spokes for vehicle wheels by means of a single casting.

2. History of the Related Art

Wheel rims are known, which consist of several parts made of stamped and/or forged sheet material.

Such rims are rather heavy and unpleasing to look at; they are normally used for mass-produced economical cars and are provided with covers.

Wheel rims are also known, which are obtained from the casting of metal in a single piece. Such rims, the spokes of which have a U-shaped section, are characterized by a pleasant look and are mounted on medium-high class cars. They are normally made of metal alloys with low specific weight.

It is well known that, with the same material, a hollow tubular element is much more resistant than a solid one.

Any kind of wheel rim does not only provide for connection between a tire and the vehicle, but has also other functions.

The air inside the tire heats while the vehicle is moving, thus heating also the metal rim; the air outside the tire touches the metal surfaces and thus reduces the overheating of the air inside the tire and therefore of the whole wheel.

The larger the exchange surfaces in the tire air-metal rim-environment, the better is the cooling of the whole wheel.

When the wheels are used on uneven ground or when there are irregularities in the road layout, part of the stress is absorbed by the tire, which is subject to elastic deformation, thus causing the compression of the air inside the tire. Therefore, the greater is the air volume inside the tire, the lesser is the stress transmitted to the vehicle by the wheel. The above-mentioned problems are further increased in races.

At present more castings are made to obtain alloy rims with hollow spokes; a first casting is made to obtain the hub and the hollow spokes and a second casting to obtain the whole rim, by putting the hub and the already cast spokes inside the die.

The need to make two successive castings doesn't make it possible to get very good results, since the obtained rim doesn't consist of homogeneous material and has less resistance along the surface joining the two successive castings.

To carry out the rim with the above-described system sand cores are used which, during the casting, can partly mix with the metal and modify its characteristics, leave the surfaces irregular and rough and can cause microcracks. Such microcracks are invisible to the naked eye, but allow air emissions from the inside of the tire, thus making the rim unusable for tubeless tire.

SUMMARY OF THE INVENTION

In order to solve these problems, a new die has been designed, which makes it possible to form vehicle wheel rims with tubular spokes without the use of sand and with a single casting.

The dies used today consist of more parts, two of which form inner and outer parts of the rim, while the rest, in varying number, make up the circumference of the rim on which the tire is mounted.

The inner and outer parts of the die are similar to the known ones.

On the contrary, the parts which make up the circumference are characterized by a circle arc-shaped hollow surface, which forms the circular surface of the rim, provided with one or more protuberances. Each protuberance is dimensioned in such a way as to be located inside a spoke forming portion of the die during the rim casting; it is shorter than the spoke portion, so that it reaches neither the hub portion, nor the inside of the rim portion adjacent where the fastening holes are formed.

In particular, each protuberance is provided with preferably rectilinear longitudinal axis and is preferably conical and coaxial with the spoke.

When the die is closed, among the surfaces of the two side parts of the spokes and the above-mentioned protuberances there is the space necessary and sufficient for the injection of liquid metal, so that the casting has the necessary resistance.

When the metal has properly hardened, the die can be opened and each part of the die making up the rim circumference is removed, so as to allow the extraction of each protuberance from a spoke without any damage.

In this way, the core which makes it possible to form the hollow spoke consists of the protuberance removed on the opening of the die.

The shape and the dimensions of each protuberance are such as to make up a volume inside the spoke; such volume has to be precise and without a break, non-communicating with the outside of the hub, if not on the circular surface inside the tire.

The above-described die with protuberances ensures several advantages:

- it is not necessary to carry out two successive castings, which makes it possible to increase the hourly production and the rim quality, since the metal is homogeneous in any point of the rim;
- there are no inconsistent matters (sand or other) which can cause microcracks in the metal and mass differences in the rim;
- the whole surface of the rim is smoother, especially inside the spokes, which considerably reduces the successive processes.

If necessary, the protuberances can be removable from the parts of the die circumference, in such a way as to make it possible to apply different protuberances on the same parts of the die circumference and thus to obtain different rims.

By using this method it is also possible to form rims with inclined spokes with respect to the rotational axis of the rim.

The parts making up the circumference have an arc-shaped hollow surface, which forms the outer circular surface of the rim, provided with the movable protuberances.

In particular, each protuberance can move, on the part of the die where it is housed, along a radial direction inclined with respect to the rotational axis of the rim.

Further, each protuberance is preferably conical and coaxial with each spoke.

The various parts of the die, sides and parts of the circumference are moved toward and away from one another by proper mechanisms, hydraulic jacks or other means; additional jacks carry out the relative movement of the protuberances with respect to the relevant parts of the rim circumference.

When the metal has properly hardened and the die is opened, there are different and successive movements for the various parts of the die.

The direction of movement of each protuberance is different from and not parallel to the direction of movement of the die part on which it is housed; therefore, at first the protuberances are moved away, that is, they are urged away from the rim center until they are completely out of the hollow spoke; the other parts of the die are then moved away, thus releasing the just cast rim.

Due to the different direction of movement of the protuberances and of the parts of the circumference die, it is possible to open the die even if there are more protuberances housed on the same part of the die circumference.

In this way, the core which makes it possible to obtain the hollow spoke is made up by the protuberance which is removed immediately before the opening of the die.

The new rim, obtained by means of the new dies and processes, is the result of a single casting, which ensures the homogeneity of the metal in any point and reduces production times; sand or the alike are not used, thus avoiding any contamination of the metal, microcracks and mass differences in the rim.

A rim characterized by higher mechanical resistance is thus obtained; the rim can be of any shape and have a varying number of spokes with different shapes and directions, which gives great advantages as regards both costs and performance.

Each spoke can have linear, curved or any other shape; its section can be circular, elliptical, oval, concave, convex or have any suitable shape.

The opening through which each spoke communicates with the part of the rim channel inside the tire has dimensions similar to those of the inner section of the spoke and is perfectly and properly jointed with the surface of the channel.

The air quantity inside the tire is greater than in normal tires, since there is air also inside the spokes; in this way, the stress due to the irregularities of the road surface is better absorbed by the wheel and transmitted to the vehicle in reduced quantity.

Further, the air inside the tire exchanges heat with a surface which is greater than the rim (inner surface of the spokes), which in turn is cooled by the external air.

In the new rim the channel which houses the tire can thus have reduced depth, thus improving the stability of the vehicle.

As already mentioned, the obtained wheels can have shapes and dimensions considerably different from the known kinds of wheel.

In fact, besides the fact that the spokes can be inclined outwards and that the wheel directing members can get near the wheel center, the spokes can also have non-radial directions, for example they can be tangent to the rim center.

BRIEF DESCRIPTION OF THE DRAWINGS

The following is just an example among many of the invention in question, illustrated in the attached drawings wherein.

DESCRIPTION OF THE PREFERRED EMBODIMENT

Figure 1:
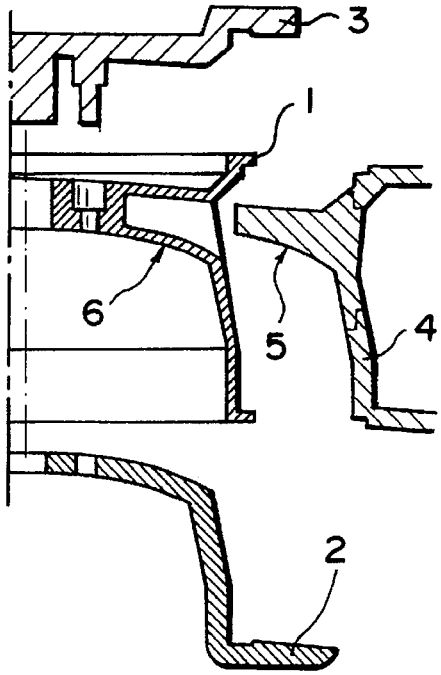
FIG. 1 is a partial illustrational assembly view showing the die components of the present invention as they are used to form a portion of a wheel rim.

FIG. 1 shows a partial vertical section of the rim (1), of the side parts of the rim die (2, 3) and of one of the die parts (4) making up the circumference of the rim.

The protuberance (5) and the compartment created by the protuberance inside the spoke (6) of the rim (1) can be clearly observed.

Figure 2:
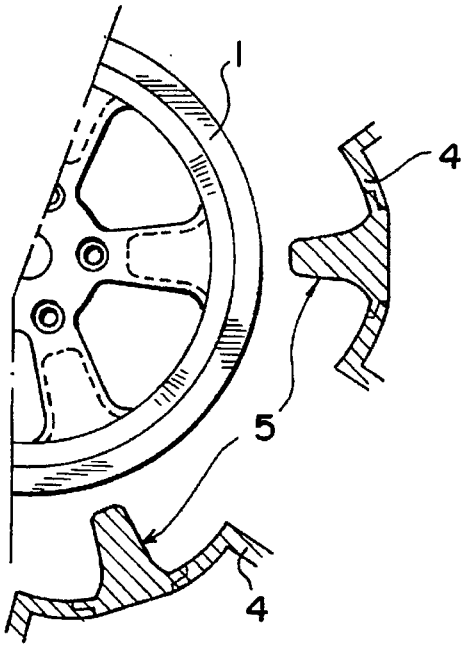
FIG. 2 is a partial top plan illustrational view showing the circumference die portions and protuberances associated with forming the spokes in the wheel rim of the present invention.

FIG. 2 shows a side view of part of the rim (1) and two of the die parts (4) making up the rim circumference with the relevant protuberances (5).

Figure 3:
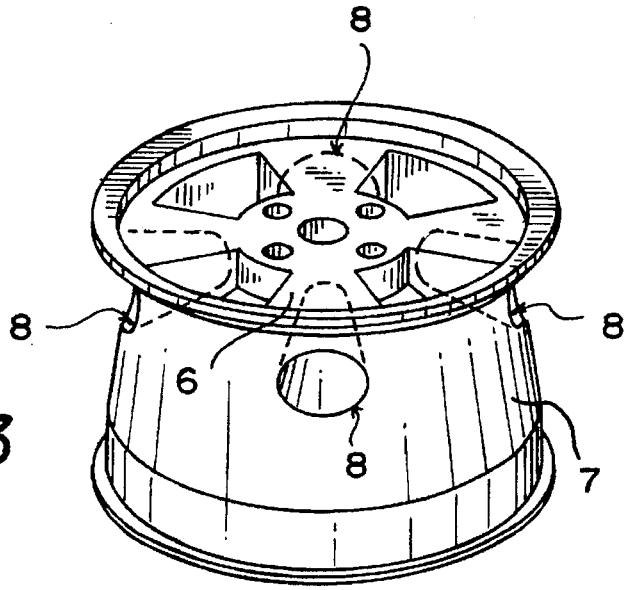
FIG. 3 is a perspective view of a wheel rim formed in accordance with the die of FIG. 1.

FIG. 3 is a schematic view of a four-spoke (6) rim, where each spoke is hollow and communicates with the rim (1) channel through a hole (8) having proper dimensions.

Figure 4:
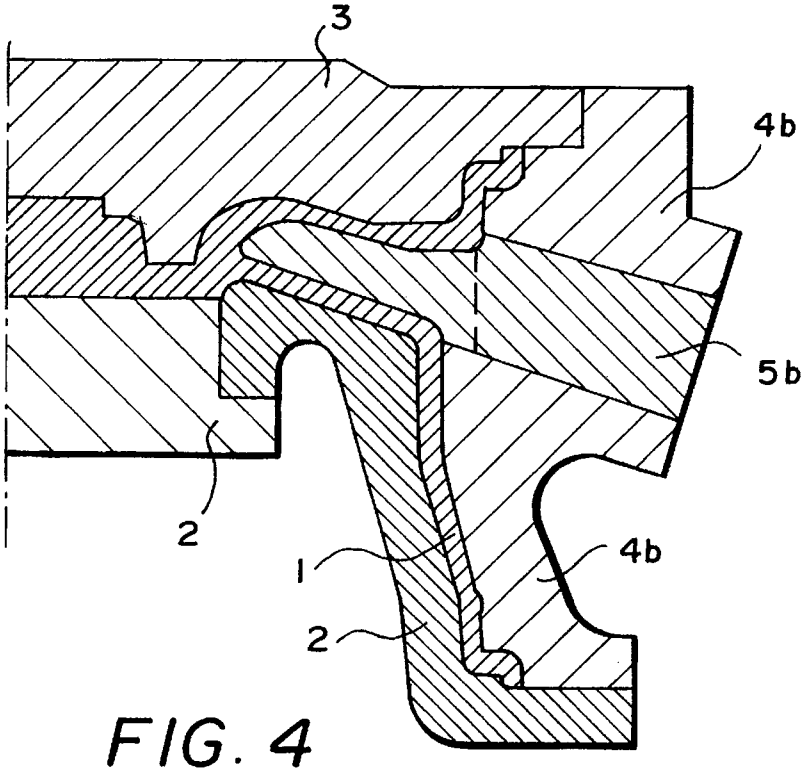
FIG. 4 is an enlarged partial cross-sectional view of the die components shown in FIG. 1 showing a protuberance member extending through a circumference die component intermediate the upper and lower die halves.

FIG. 4 shows a partial vertical section of the rim (1), of the side parts of the rim die (2, 3) and of one of the die parts (4) making up the rim circumference.

The protuberance (**5*b*), movable in one of the die parts (4*b***) which make up the circumference, can be clearly observed.

Figure 5:
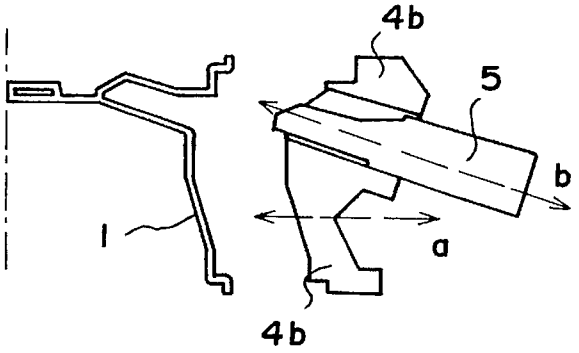
FIG. 5 is an illustrational view showing the relative movement between the protuberance portion for forming the hollow spokes utilizing the die of the present invention as it moves relative to a circumference portion of the die.
Figure 6:
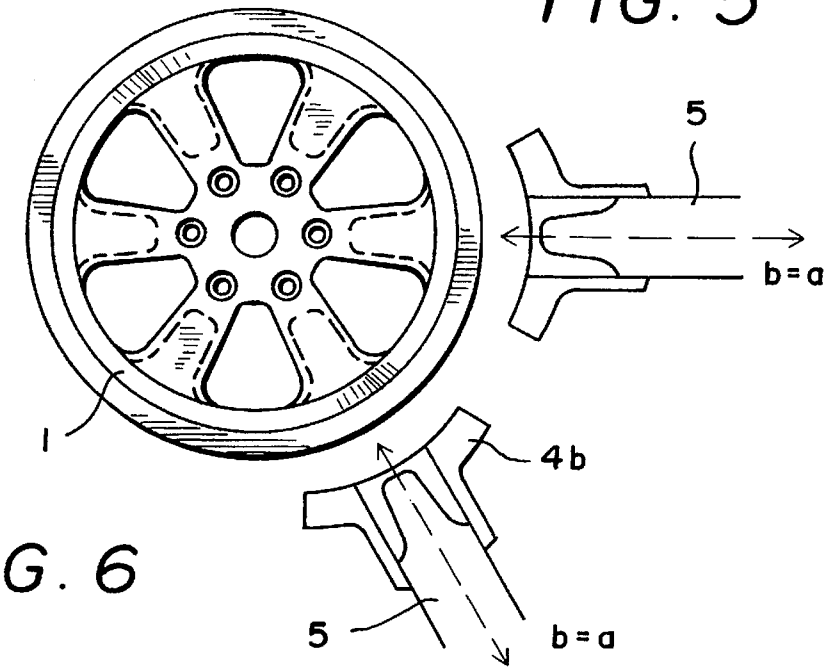
FIG. 6 is an illustrational view showing the relative movement between the protuberances for forming the hollow spokes in a wheel rim utilizing the die components of the present invention.

FIGS. 5 and 6 are schematic views of the rim (1) and of the parts of the die (4) making up the circumference. Dotted lines indicate the sliding direction (a) of the die part (4) and the sliding direction (b) of the protuberances (5) in the die part (**4*b***).

The above are the basic outlines of the invention, on the basis of which the technician will be able to provide for implementation; therefore, any change which may be necessary upon implementation is to be regarded as completely protected by the present invention.

With reference to the above description and the attached drawings, the following claims are put forth.

I claim:

1. A die for use in casting vehicle wheel rims which include a hub from which extend a plurality of spokes which spokes are generally hollow from a point spaced from the hub to an outer channel in which a tire is selectively mountable, the die comprising, first and second parts corresponding to the inner and outer sides of the wheel rim, said first and second parts including central portions for forming a hub of a wheel rim and intermediate portions extending from the central portions for forming the spokes and outer portions, a plurality of circumference components engageable with said outer portions of said first and second parts, a plurality of protuberances equal in number to the plurality of spokes of the wheel rim extending inwardly relative to one another from the circumference components, each protuberance being of a dimension such that when inserted between the first and second parts of the die, such protuberances are spaced from said central portions thereof wherein the wheel hub is formed whereby the spokes are solid extending from the hub and are hollow thereafter to the outer channel.

2. The die for casting wheel rims of claim 1 in which said protuberances are removably mounted to said circumference components of said die whereby said protuberances may be interchanged to vary the configuration of the spokes of a formed wheel rim.

3. The die for casting wheel rim of claim 1 in which said protuberances are independently moveable with respect to said circumference components whereby said protuberances may be removed from between said first and second die parts prior to removing said circumference components relative to said first and second die parts.

* * * * *